US009323261B2

(12) United States Patent
Lin et al.

(10) Patent No.: US 9,323,261 B2
(45) Date of Patent: Apr. 26, 2016

(54) INTERNAL VOLTAGE GENERATING APPARATUS

(71) Applicant: Winbond Electronics Corp., Taichung (TW)

(72) Inventors: Chih-Feng Lin, Hsinchu County (TW); Kuen-Huei Chang, Taipei (TW)

(73) Assignee: Winbond Electronics Corp., Taichung (TW)

( * ) Notice: Subject to any disclaimer, the term of this patent is extended or adjusted under 35 U.S.C. 154(b) by 2 days.

(21) Appl. No.: 14/457,117

(22) Filed: Aug. 12, 2014

(65) Prior Publication Data

US 2016/0048146 A1 Feb. 18, 2016

(51) Int. Cl.
*G05F 1/10* (2006.01)
*G05F 1/46* (2006.01)

(52) U.S. Cl.
CPC ..... *G05F 1/465* (2013.01)

(58) Field of Classification Search
CPC ..... G05F 1/465
See application file for complete search history.

(56) References Cited

U.S. PATENT DOCUMENTS

2008/0231243 A1 9/2008 Zhong et al.
2013/0169353 A1 7/2013 Kim
2014/0055110 A1* 2/2014 Richter ..... G05F 1/565 323/281

FOREIGN PATENT DOCUMENTS

| | | |
|---|---|---|
| CN | 100590871 | 2/2010 |
| TW | 201120607 | 6/2011 |
| TW | 201346482 | 11/2013 |
| WO | 2010015662 | 2/2010 |
| WO | 2010134228 | 11/2010 |
| WO | 2013082371 | 6/2013 |

OTHER PUBLICATIONS

"Office Action of Taiwan Counterpart Application", issued on May 8, 2015, p. 1-p. 4.

* cited by examiner

*Primary Examiner* — Daniel Puentes
(74) *Attorney, Agent, or Firm* — Jianq Chyun IP Office

(57) ABSTRACT

An internal voltage generating apparatus is provided. A regulating unit detects whether an internal voltage is lower than a threshold voltage, and outputs a compensation current provided by a first power pad to a second power line connected with a second power pad when the internal voltage is lower than the threshold voltage, so as to regulate the internal voltage provided by the internal voltage generating apparatus.

8 Claims, 4 Drawing Sheets

INTERNAL VOLTAGE GENERATING APPARATUS

BACKGROUND OF THE INVENTION

1. Field of the Invention

The invention relates to an electronic apparatus and more particularly relates to an internal voltage generating apparatus.

2. Description of Related Art

With the advances in semiconductor technology, power lines inside chips become longer and more slender, which causes a serious IR drop problem that affects a normal operation of the electronic apparatus. For example, such a problem may cause memory data loss for storage devices and cause non-uniform brightness of the display panel for display devices.

Take a low power double data rate (LPDDR) dynamic random access memory (DRAM) as an example, the external voltage supply is 1.8V only, and the internal voltage of the chip is all generated through a regulator. Take the internal voltage generating apparatus shown in FIG. 1 for example, a power voltage VDD (1.8V) provided by a power pad P0 drops to voltage VDD_local (1.6V) due to the IR drop of the internal power line. However, through the regulator composed of a transistor Q1 and an operational amplifier OP0, the stable internal voltage VINT (1.2V) can still be generated.

For a LPDDR2 dynamic random access memory (DRAM), because the external voltage has an additional 1.2V, no additional regulator is required for IR drop, which is more convenient, but it becomes more difficult to eliminate the IR drop of the internal local power. Take the internal voltage generating apparatus of FIG. 2 for example, although the apparatus has dual-power supply (wherein a power pad PA provides a power voltage VDDA and a power pad PB provides another power voltage VDDB (1.2V)), the IR drop effect still causes the internal voltage VINT provided by the power voltage VDDB to drop to 1.0V and results in an abnormal operation of the electronic apparatus.

SUMMARY OF THE INVENTION

The invention provides an internal voltage generating apparatus that supplies a stable internal voltage to an electronic apparatus using the internal voltage generating apparatus.

The internal voltage generating apparatus of the invention includes a first power pad, a second power pad, and a regulating unit. The first power pad provides a compensation current. The regulating unit is respectively coupled to the first power pad and the second power pad via a first power line and a second power line, wherein the second power pad outputs the internal voltage via the power line, and the regulating unit detects whether the internal voltage is lower than a threshold voltage and outputs the compensation current to the power line when the internal voltage is lower than the threshold voltage, so as to regulate the internal voltage.

In an embodiment of the invention, the regulating unit is further enabled by an enable signal to start detecting the internal voltage.

In an embodiment of the invention, the regulating unit further includes a threshold voltage generating unit, an operational amplifier, a first power transistor, and a second power transistor. The threshold voltage generating unit generates the threshold voltage according to a power voltage provided by the second power pad. The operational amplifier includes a positive input terminal and a negative input terminal coupled to the threshold voltage generating unit and the second power line respectively. The first power transistor includes a gate receiving an ON voltage. The second power transistor and the first power transistor are connected in series between the first power line and the second power line, and a gate of the second power transistor is coupled to an output terminal of the operational amplifier.

In an embodiment of the invention, the operational amplifier is further enabled by an enable signal.

In an embodiment of the invention, the regulating unit further includes an inverter, including an input terminal that receives a power voltage provided by the first power pad, and an output terminal that is coupled to the gate of the first power transistor.

In an embodiment of the invention, the threshold voltage generating unit includes a first dividing resistor and a second dividing resistor. The second dividing resistor and the first dividing resistor are connected in series between the second power pad and a ground to divide the power voltage provided by the second power pad to generate the threshold voltage.

In an embodiment of the invention, the first power transistor is a P type power transistor and the second power transistor is an N type power transistor.

In an embodiment of the invention, the internal voltage generating apparatus further includes an electrostatic discharge protection unit coupled between the first power pad and the second power pad.

Based on the above, in the embodiments of the invention, the regulating unit detects whether the internal voltage is lower than the threshold voltage, and outputs the compensation current provided by the first power pad to the second power line connected with the second power pad when the internal voltage is lower than the threshold voltage, so as to regulate the internal voltage provided by the internal voltage generating apparatus.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
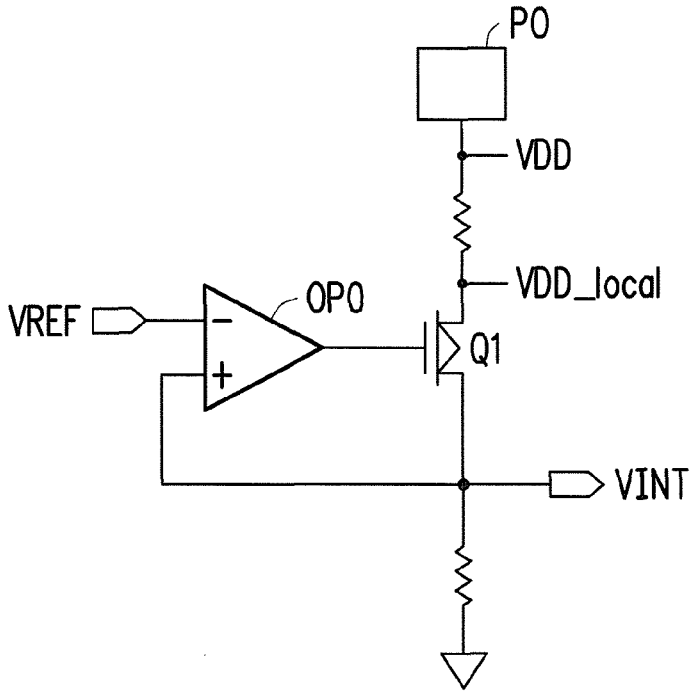
FIG. 1 is a schematic view of the conventional internal voltage generating apparatus.
Figure 2:
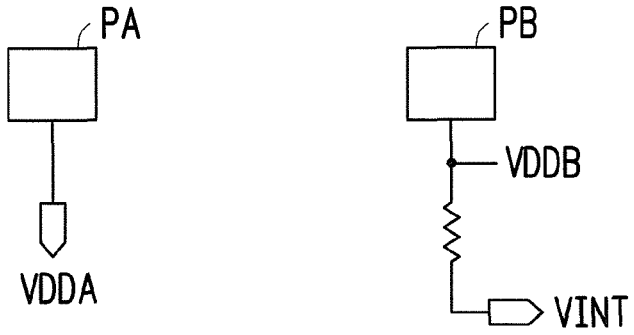
FIG. 2 is a schematic view of the conventional internal voltage generating apparatus.
Figure 3:
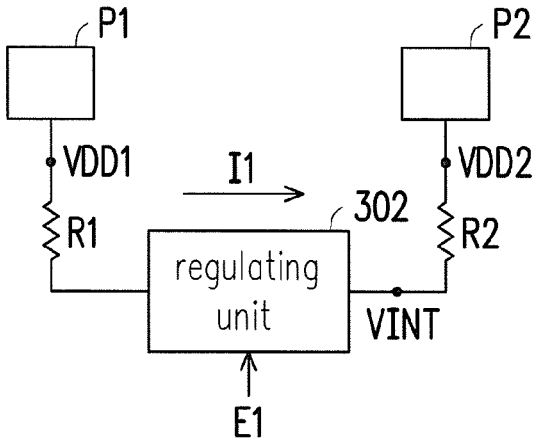
FIG. 3 is a schematic view of an internal voltage generating apparatus according to an embodiment of the invention.

FIG. 3 is a schematic view of an internal voltage generating apparatus according to an embodiment of the invention.

Please refer to FIG. 3. The internal voltage generating apparatus includes a power pad P1, a power pad P2, and a regulating unit 302, wherein the power pad P1 and the power pad P2 are respectively coupled to the regulating unit 302 via a first power line and a second power line. The first power line and the second power line have a first line resistance and a second line resistance respectively. In FIG. 3, a resistor R1 and a resistor R2 respectively represent an equivalent resistor of the first power line and an equivalent resistor of the second power line. The power pad P1 provides a power voltage VDD1 and a compensation current I1, and the power pad P2 provides a power voltage VDD2, wherein the power voltage VDD2 provided by the power pad P2 is affected by an IR drop effect generated by the resistor R2 and generates an internal voltage VINT at a common contact of the regulating unit 302 and the resistor R2.

The regulating unit 302 detects whether the internal voltage VINT is lower than a threshold voltage and outputs the compensation current I1 provided by the power pad P1 to the second power line to regulate the internal voltage VINT when the internal voltage VINT is lower than the threshold voltage, so as to prevent the internal voltage VINT from causing an abnormal operation of an electronic apparatus using the internal voltage generating apparatus due to the influence of the IR drop. In addition, the regulating unit 302 may be enabled by an enable signal E1. That is, the regulating unit 302 is enabled to perform the detection and voltage regulating operation after receiving the enable signal E1, so as to reduce power consumption of the internal voltage generating apparatus.

Figure 4:
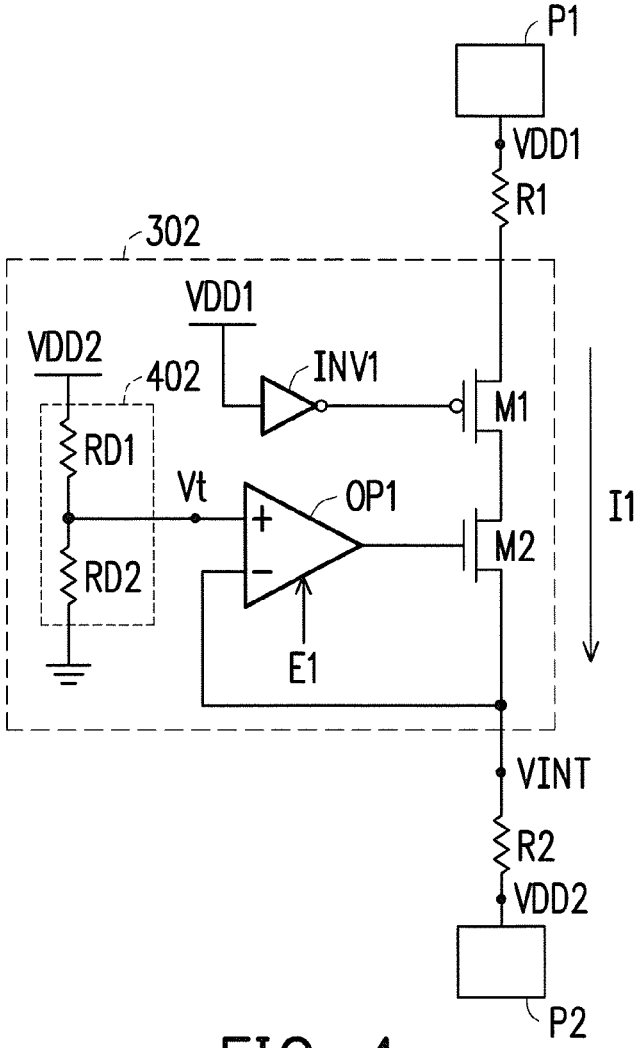
FIG. 4 is a schematic view of an internal voltage generating apparatus according to another embodiment of the invention.

FIG. 4 is a schematic view of an internal voltage generating apparatus according to another embodiment of the invention. Please refer to FIG. 4. More specifically, an implementation of the internal voltage generating apparatus is illustrated in FIG. 4, for example, wherein the internal voltage generating apparatus includes a threshold voltage generating unit 402, an operational amplifier OP1, an inverter INV1, a power transistor M1, and a power transistor M2. A positive input terminal of the operational amplifier OP1 is coupled to the threshold voltage generating unit 402. A negative input terminal of the operational amplifier OP1 is coupled to a common contact of the resistor R2 and the power transistor M2 (i.e. connected in series with the common contact of the second power line and the power transistor M2). The power transistor M1 and the power transistor M2 are connected in series between the resistor R1 and the resistor R2 (i.e. connected in series between the firs power line and the second power line). A gate of the power transistor M1 is coupled to an output terminal of the inverter INV1. A gate of the power transistor M2 is coupled to an output terminal of the operational amplifier OP1. An input terminal of the inverter INV1 is coupled to the power voltage VDD1. In this embodiment, the power transistor M1 is a P type power transistor and the power transistor M2 is an N type power transistor.

After being inverted by the inverter INV1, the power voltage VDD1 becomes an ON voltage to be outputted to the gate of the power transistor M1 to maintain the power transistor M1 in an ON state. The threshold voltage generating unit 402 generates a threshold voltage Vt according to the power voltage VDD2, and the operational amplifier OP1 compares the threshold voltage Vt with the internal voltage VINT. When the internal voltage VINT is lower than the threshold voltage Vt, it indicates that the voltage value of the internal voltage VINT is relatively low due to the influence of the IR drop caused by the second power line. Then, the operational amplifier OP1 turns on the power transistor M2 to cause the compensation current I1 provided by the power pad P1 to flow to the second power line and the power pad P2, so as to compensate for the internal voltage VINT to achieve the effect of voltage regulation. In addition, the operational amplifier OP1 may also be enabled by the enable signal E1. The operational amplifier OP1 is enabled to perform the aforementioned operation after receiving the enable signal E1, so as to reduce the power consumption of the internal voltage generating apparatus.

As shown in FIG. 4, for example, the threshold voltage generating unit 402 includes dividing resistors RD1 and RD2, wherein the dividing resistors RD1 and RD2 are connected in series between the power voltage VDD2 provided by the power pad P2 and a ground, and a common contact of the dividing resistors RD1 and RD2 is coupled to the positive input terminal of the operational amplifier OP1. Resistance values of the dividing resistor RD1 and the dividing resistor RD2 are far larger than the resistor R2. The resistance values of the dividing resistors RD1 and RD2 may be designed according to the voltage value of the internal voltage VINT. For example, given that the power voltage VDD2 is 1.2V, the resistances of the dividing resistors RD1 and RD2 may be set to 100KΩ and 1100KΩ respectively.

Figure 5:
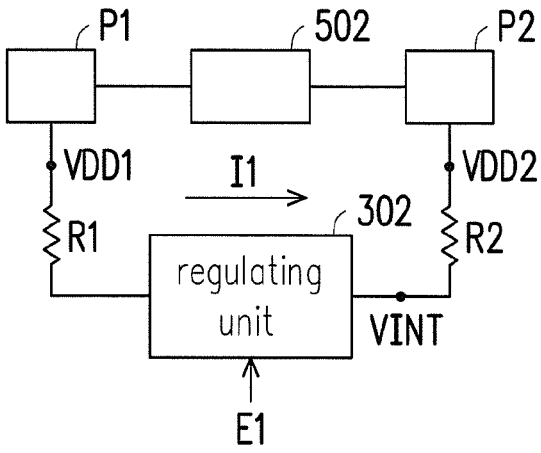
FIG. 5 is a schematic view of an internal voltage generating apparatus according to another embodiment of the invention.
Figure 6:
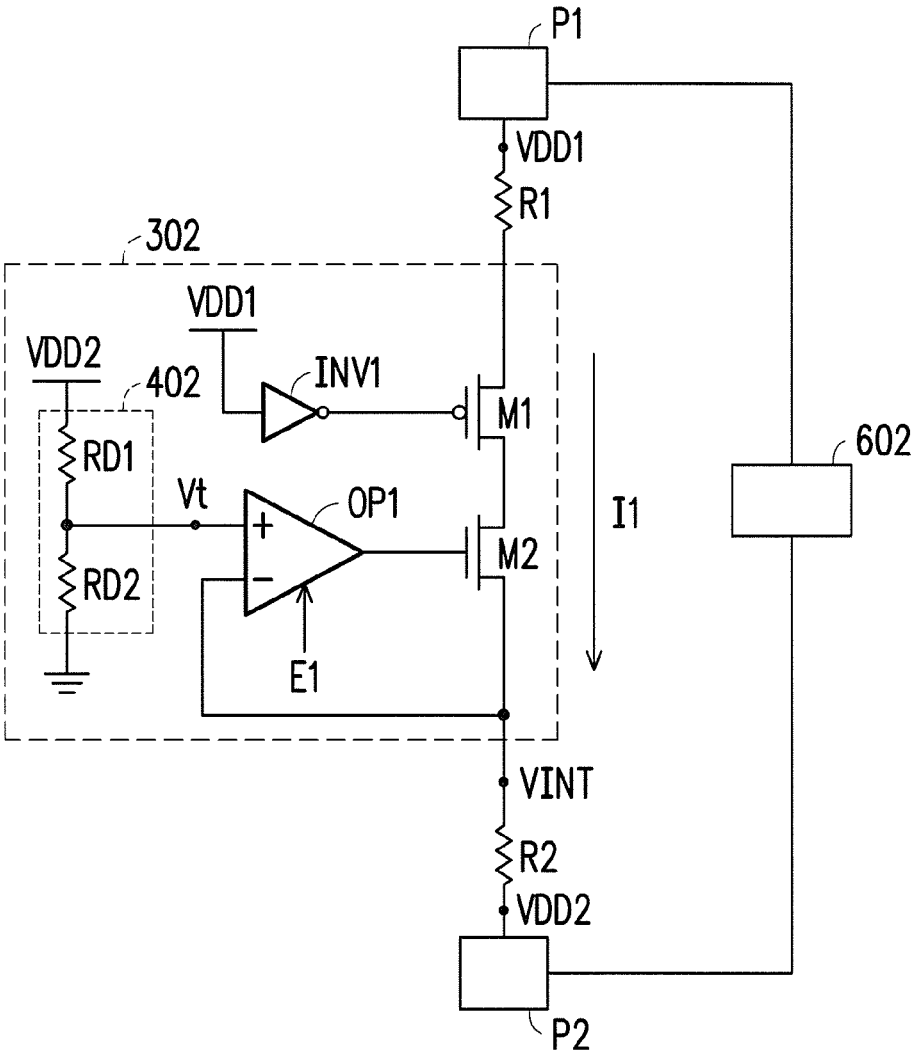
FIG. 6 is a schematic view of an internal voltage generating apparatus according to another embodiment of the invention.

FIG. 5 and FIG. 6 respectively illustrate the internal voltage generating apparatuses in the embodiments of the invention. A difference between FIG. 5 and FIG. 3 and FIG. 6 and FIG. 4 is that the internal voltage generating apparatuses of FIG. 5 and FIG. 6 further include an electrostatic discharge protection unit 502 and an electrostatic discharge protection unit 602 respectively. The electrostatic discharge protection unit 502 is coupled between the power pad P1 and the power pad P2 in FIG. 5. The electrostatic discharge protection unit 602 is also coupled between the power pad P1 and the power pad P2 in FIG. 6. Thus, when an electrostatic current is generated, the electrostatic discharge protection unit 502 or the electrostatic discharge protection unit 602 discharges the electrostatic current out of the internal voltage generating apparatus through the power pad P1 and the power pad P2 to prevent the electrostatic current from flowing into the regulating unit 302 to cause damage. In FIG. 6, the power transistor M1 increases the resistance to the electrostatic current flowing into the regulating unit 302, so as to prevent the regulating unit 302 from being damaged by the electrostatic current, and the power transistor M1 may be driven via the inverter INV1. Moreover, the number of the power transistors M1 is not limited by the disclosure of the embodiment of FIG. 6. In other embodiments, the number of the power transistors M1 connected in series with the power transistor M2 may be increased to increase the resistance to the electrostatic current flowing into the regulating unit 302.

Figure 7:
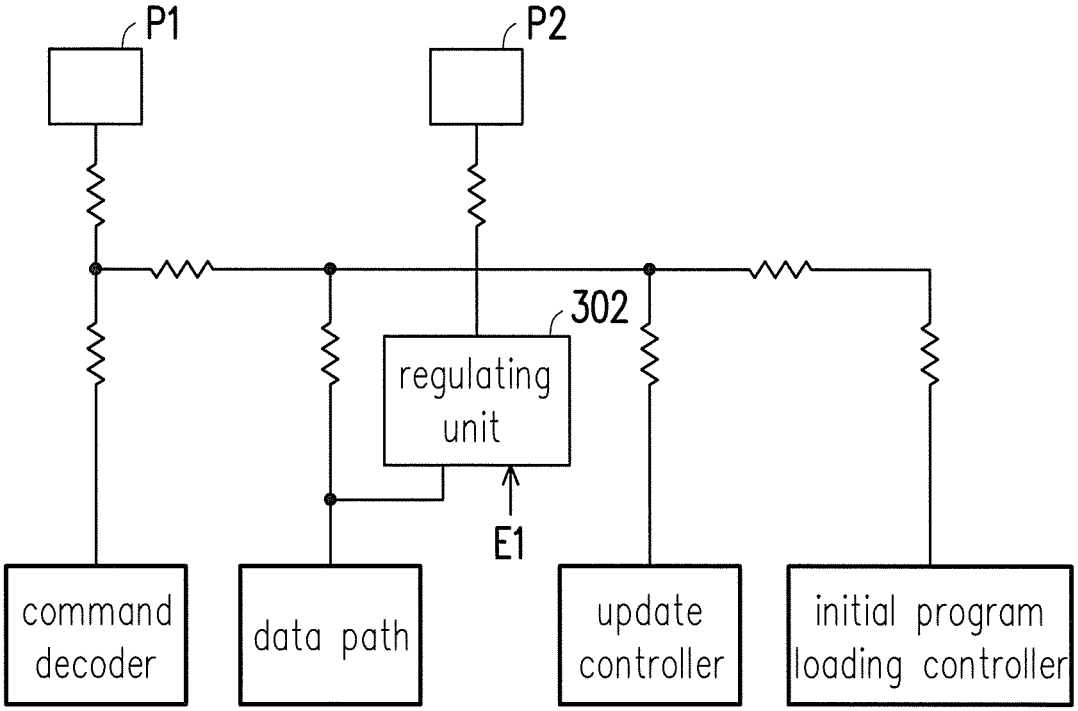
FIG. 7 is a schematic view of the internal voltage generating apparatus of the embodiment of the invention applied to a dynamic random access memory (DRAM).

FIG. 7 is a schematic view of the internal voltage generating apparatus of the embodiment of the invention applied to a dynamic random access memory (DRAM). Please refer to FIG. 7. A resistor shown in FIG. 7 is an equivalent resistor of the power line. To prevent the power voltage VDD1 from consuming too much current, the internal voltage generating apparatus may be disposed near a circuit that is more sensitive to the voltage. As shown in FIG. 7, because a data path may be easily affected by the IR drop effect, which reduces a data transmission speed of the data path, the internal voltage generating apparatus may be disposed near the data path to compensate for the IR drop. In addition, because the data path consumes the compensation current provided by the regulating unit 302 only during writing and reading, operation time of the regulating unit 302 can be controlled by the enable signal E1. That is to say, the regulating unit 302 is enabled by the enable signal E1 to perform voltage regulation only during writing and reading, so as to achieve the effect of reducing power consumption.

To conclude the above, in the embodiments of the invention, the regulating unit detects whether the internal voltage is lower than the threshold voltage, and outputs the compensation current provided by the first power pad to the second power line connected with the second power pad when the internal voltage is lower than the threshold voltage, so as to regulate the internal voltage provided by the internal voltage generating apparatus. In some of the embodiments, the regulating unit further performs the detection and regulating operation of the internal voltage after receiving the enable signal, so as to reduce the power consumption of the internal voltage generating apparatus.

What is claimed is:

1. An internal voltage generating apparatus, comprising:

a first power pad providing a compensation current;

a second power pad; and a regulating unit respectively coupled to the first power pad and the second power pad via a first power line and a second power line, wherein the second power pad outputs an internal voltage via the second power line, and the regulating unit detects whether the internal voltage is lower than a threshold voltage and outputs the compensation current to the second power line when the internal voltage is lower than the threshold voltage, so as to regulate the internal voltage.

2. The internal voltage generating apparatus according to claim 1, wherein the regulating unit is further enabled by an enable signal to start detecting the internal voltage.

3. The internal voltage generating apparatus according to claim 1, wherein the regulating unit comprises:

a threshold voltage generating unit generating a threshold voltage according to a power voltage provided by the second power pad;

an operational amplifier comprising a positive input terminal and a negative input terminal coupled to the threshold voltage generating unit and the second power line respectively;

a first power transistor comprising a gate receiving an ON voltage; and a second power transistor, wherein the first power transistor and the second power transistor are connected in series between the first power line and the second power line, and a gate of the second power transistor is coupled to an output terminal of the operational amplifier.

4. The internal voltage generating apparatus according to claim 3, wherein the operational amplifier is further enabled by an enable signal.

5. The internal voltage generating apparatus according to claim 3, wherein the regulating unit further comprises:

an inverter comprising an input terminal that receives a power voltage provided by the first power pad, and an output terminal that is coupled to the gate of the first power transistor.

6. The internal voltage generating apparatus according to claim 3, wherein the threshold voltage generating unit comprises:

a first dividing resistor; and a second dividing resistor, wherein the first dividing resistor and the second dividing resistor are connected in series between the second power pad and a ground to divide the power voltage provided by the second power pad to generate the threshold voltage.

7. The internal voltage generating apparatus according to claim 3, wherein the first power transistor is a P type power transistor and the second power transistor is an N type power transistor.

8. The internal voltage generating apparatus according to claim 1, further comprising:

an electrostatic discharge protection unit coupled between the first power pad and the second power pad.

* * * * *